United States Patent [19]

Zanatta

[11] Patent Number: 4,601,118

[45] Date of Patent: Jul. 22, 1986

[54] SKI-BOOT WITH A BOOT LEG HAVING ADJUSTABLE SIDE INCLINATION

[75] Inventor: Ruggero Zanatta, Nervesa della Battaglia, Italy

[73] Assignee: Calzaturificio Tecnica spa, Nervesa della Battaglia, Italy

[21] Appl. No.: 511,028

[22] Filed: Jul. 5, 1983

[30] Foreign Application Priority Data

Jul. 19, 1982 [IT] Italy ..... 22429/82[U]

[51] Int. Cl.[4] ..... A43B 5/04

[52] U.S. Cl. ..... 36/120; 36/121

[58] Field of Search ..... 36/117, 120, 121

[56] References Cited

U.S. PATENT DOCUMENTS

| | | | |
|---|---|---|---|
| 3,885,329 | 5/1975 | French | 36/120 |
| 4,062,133 | 12/1977 | McGee et al. | 36/120 |
| 4,152,849 | 5/1979 | Frechin et al. | 36/120 |
| 4,334,368 | 6/1982 | Chalmers, II et al. | 36/121 |

FOREIGN PATENT DOCUMENTS

| | | | |
|---|---|---|---|
| 1066889 | 11/1979 | Canada | 36/120 |
| 2807371 | 8/1979 | Fed. Rep. of Germany | 36/121 |
| 2394995 | 2/1979 | France | 36/121 |

*Primary Examiner*—Werner H. Schroeder
*Assistant Examiner*—Steven N. Meyers
*Attorney, Agent, or Firm*—Pollock, Vande Sande & Priddy

[57] ABSTRACT

Ski boot comprising a boot body for housing the skier's foot, a boot enclosing the lower part of the and hinged to the body to permit the boot leg to be forwardly inclined with respect to the boot body, and a device provided between the boot leg and the boot body permitting their vertical relative displacement.

7 Claims, 7 Drawing Figures

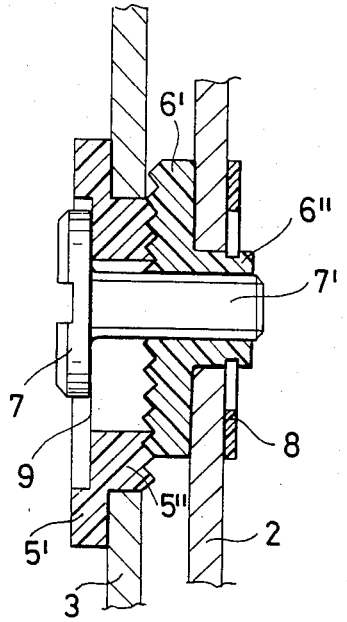
Fig.2
Fig.3
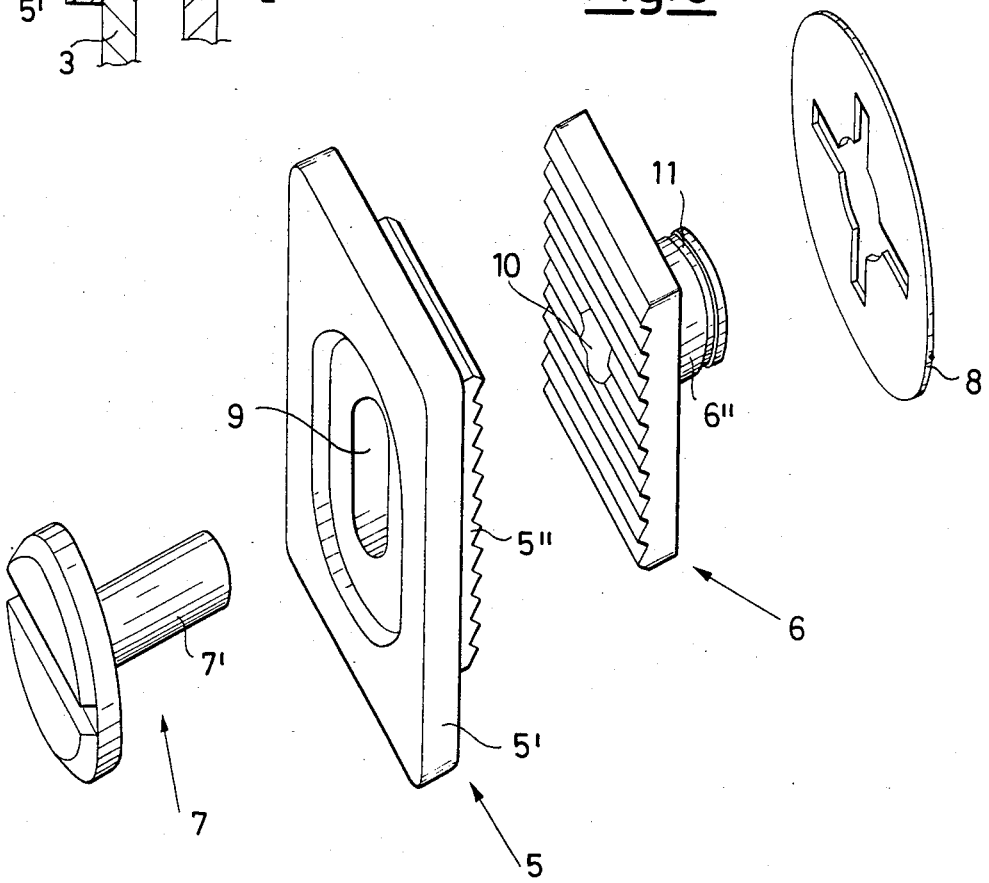

SKI-BOOT WITH A BOOT LEG HAVING ADJUSTABLE SIDE INCLINATION

FIELD OF THE INVENTION

The present invention relates to a ski boot having a shape and arrangement of component parts by which the ski boot is afforded particular usefulness.

BACKGROUND OF THE INVENTION

Ski boots of the type contemplated by the present invention normally comprise a foot housing body and a boot leg connected to the body and encompassing the lower part of the leg. These boots comprise hinged joints between the boot leg and the body allowing forward bending of the tibia, towards the boot sole, according to the typical position of the skier on the ski. However, they do not permit adjustment of the side inclination of the boot leg towards either the inner or the outer part of the foot.

The ski boots are usually designed for normal legs the axis of which is inclined by 2° to 3° towards the outer side and the boot leg is fixed to the body with this inclination. If the skier has a tibial deformation (being knock-kneed or bow-legged), upon wearing normal boots his body weight tilts to a greater extent towards the outer or inner side as the case may be. In order to keep the ski flat, the skier is thus compelled to adjust the position of his knees from the one normally required for the practice of this skiing, with obvious results both as regards the stresses acting on his limbs and as regards performing style.

OBJECT OF THE INVENTION

The object of the present invention is to overcome such drawbacks of conventional ski boots, by providing a ski boot having a configuration adaptable to the morphology of the lower limbs of the skier.

These and other purposes are achieved by means of the boot of the present invention of the type comprising a boot body for housing the foot and a boot leg, joined to the skier's body, which encompasses the lower portion of the leg, said boot leg being anchored to the body by means of members permitting the forward movement of the boot leg with respect to the boot body, said boot being essentially characterized in that adjustable means are provided between said boot leg and said body permitting vertical displacement of the boot leg with respect to the boot body.

According to another feature of the boot according to the present invention said means consist of two cooperating toothed blocks, the first being secured to the boot leg and the second to the boot body, said blocks being locked to each other by means of a horizontal pin or screw passing through suitable holes formed in the body part of said blocks, said pin being vertically slidably housed within a slot provided in the body part of one of said blocks.

Said means of the present invention are provided at the outer side attachment of the boot leg to the boot body.

The presence of the afore-mentioned means permits the side inclination of boot leg to be adjusted with respect to the boot body so as to make the boot adaptable to the morphology of the lower limbs of the skier, who may thus practise the sport without having to compensate morphological differences with respect to the standard characteristics of ski boots.

BRIEF DESCRIPTION OF THE DRAWINGS

These and other advantages will be appreciated from the following description referred to the figures of the accompanying drawings showing, for purposes of illustration, a preferred embodiment of the invention.

FIG. 2 is a cross section view of the detail of the adjustable attachment between boot body and boot leg, FIG. 3 is an exploded view of the attachment shown in FIG. 2.

The ski boot 1 comprises a body 2, in which the skier foot is housed, and a boot leg 3 encompassing the lower parts of the legs.

The body 2 and the boot leg 3 are connected to each other by means of one or more hinges (not shown and well known per se), permitting the boot leg to be forwardly rotated in the direction of the tip 2' of the body 2.

Figure 1:
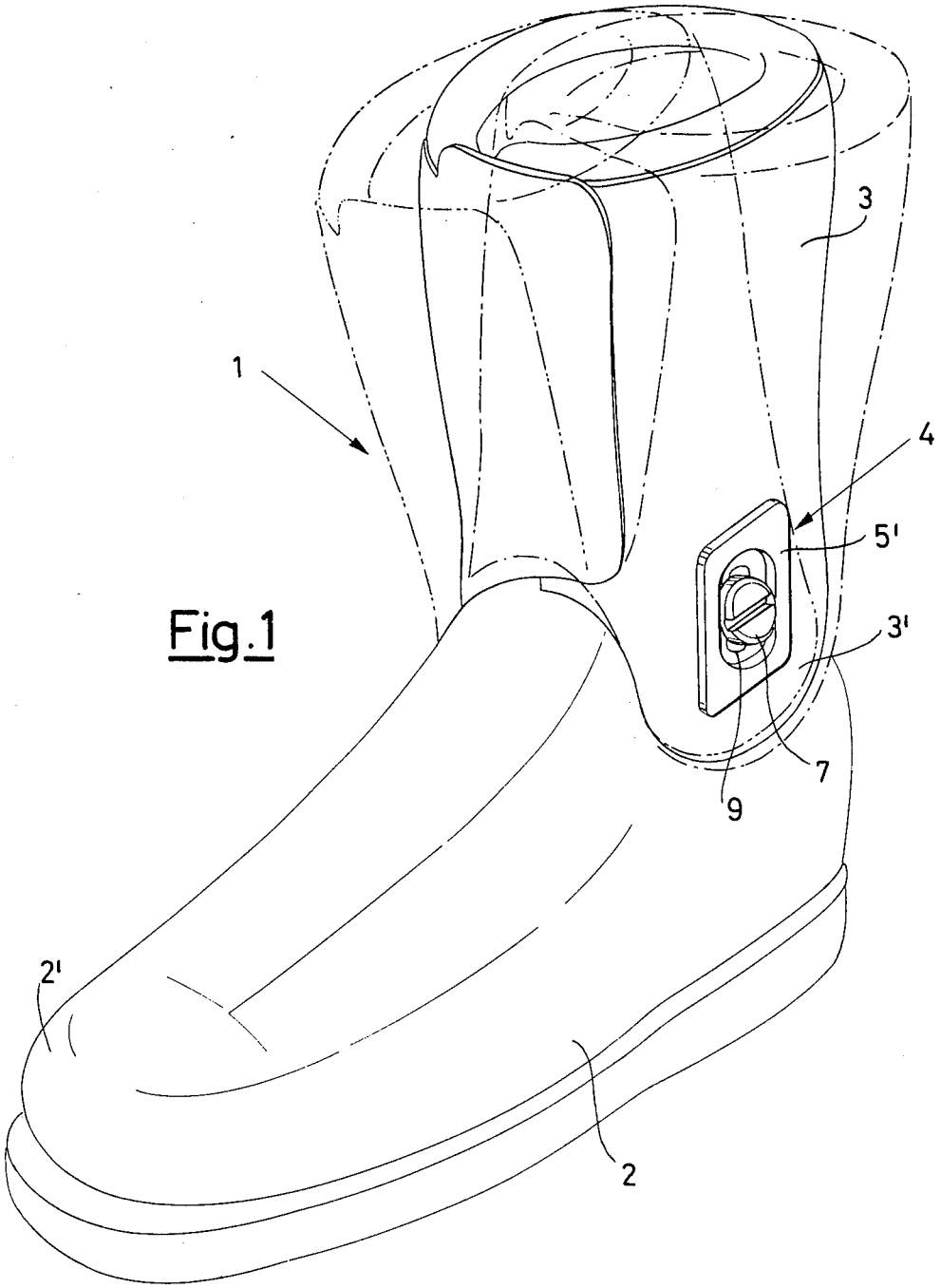
FIG. 1 is a perspective view of the overall ski boot of the invention.
Figure 4:
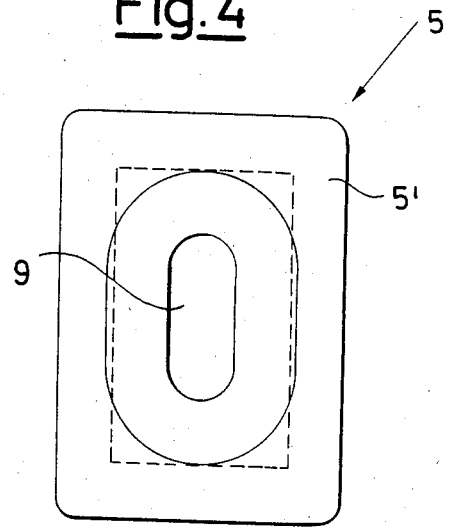
FIGS. 4 to 7 are plan and side views of the components forming the adjustable attachment shown in FIG. 3.
Figure 5:
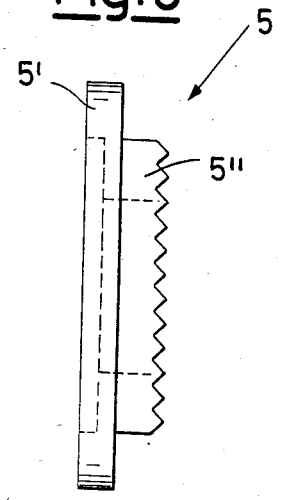
Figure 6:
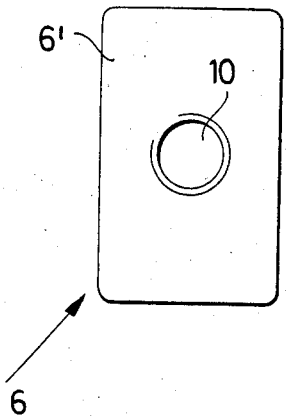
Figure 7:
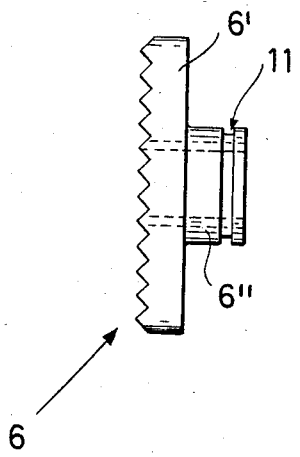

At the outer side attachment 3' between the boot leg 3 and the body 2, means 4 are provided for the adjustment of the side inclination of the boot leg boot (as shown by the dashed lines in FIG. 1). Said means 4 consist of a pair of blocks 5,6, a pin 7 and a spring washer 8 (see FIGS. 3 and 7).

The block 5, which, like all the other parts, is suitably made from rigid and mechanically resistant plastic material essentially comprises a platelet 5' having on one side a projection or shoulder 5'' with a ribbed outer surface. In the thickness of the block 5 there is further provided a slot 9 for housing the stem 7' of the pin or screw 7, said stem being freely slidable along the longitudinal length of the slot 9.

The block 6 is constituted by a plate 6' having a ribbed base on one side and a circular shoulder 6'' on the other side.

A screw threaded hole 10, coaxial with respect to the shoulder 6'', is provided through the entire block 6', the screw threaded end of the screw 7 being engaged therewith.

A circular groove 11 is provided on the free end of the said shoulder 6'', the spring washer 8 being snapped thereinto.

The mutual engagement of the above described parts is illustrated in the cross-section view of FIG. 2.

The circular shoulder 6'' and the body 2 are in a mutual engagement such that said block 6 is rotatably attached permitting fore and aft movement of the boot leg 3 in relation to the body 2 during skiing.

In a suitable opening of the boot leg 3 there is inserted in a restrained manner the ribbed shoulder 5'' of the block 5, whereas the shoulder 6'' of the block 6 is inserted in an opening of the boot body 2.

The block 5 is maintained adherent to the wall of the body 2 by means of the spring washer 8.

The ribs of the shoulder 5'' of the block 5 and of the plate 6' of the block 6, when mounted, are in engagement with each other, so as to prevent relative vertical displacement between these two parts. Detachment of the blocks 5 and 6 from each other is prevented by the screw 7, the stem 7' of which is screwed into the screw thereaded seat 10 of the block 6. The operation of the above described assembly is a follows:

When the skier desires to modify the side inclination of the boot leg 3, the screw 7 (outwardly protruding from the boot) is loosened by a length necessary to disengage the ribs of the blocks 5 and 6 from each other. The boot leg 3 is then inclined sidewise until the desired degree of inclination is achieved (see FIG. 1). During the latter operation, the stem 7' of the screw 7 does slides in a vertical direction along the slot 9 of the block 5; thereafter, by tightening the screw 7, the engagement between the toothed surfaces of the blocks 5 and 6 is restored.

Although it is evident from the figures, it is to be noted that the block 5 is mounted to the boot leg 3 with the slot 9 vertically oriented. Moreover it is to be noted that the above described assembly permits the boot leg 3 to be freely rotated with respect to the body 2, so that the skier is enabled to forwardly bring the tibiae towards the tip of the boot.

As a matter of fact the assembly comprising the block 5, boot leg 3, block 6 and screw 7 is a rigid system which is rotatable around the axis of the screw 7 with respect to the boot body 2.

More particularly the above described assembly may rotate through pressure of the leg of the skier on the boot leg, within the slot formed, in the wall of the body 2, in which said assembly is engaged at the shoulder 6'' of the block 6, which in that case is the rotation pin. The slot 9 can be provided in the block 6, instead of the block 5, and the screw 7 can be substituted for by an unthreaded pin. Moreover, the blocking against vertical displacement between blocks 5 and 6 can be accomplished by other means having like functions.

I claim:

1. Ski boot of the type comprising a foot housing body and a boot leg joined to said body and enclosing the lower portion of a skier's leg, said boot leg being anchored to said body by means permitting fore and aft movement thereof with respect to said body during skiing, comprising adjustable means between the said boot leg and said body permitting horizontal displacement of said boot leg with respect to said body, said means comprising two cooperating blocks having ribbed surfaces, a first of said blocks being fixed to said boot leg and the second of said blocks being rotatably attached to said boot body and thereby permitting said fore and aft movement to occur, said blocks being connected to each other by means of a horizontal pin passing through openings formed in said blocks and vertically slidably housed within a slot formed in a body portion of one of said blocks.

2. Ski boot according to claim 1, wherein said slot is provided in said body portion of said first block.

3. Ski boot according to claim 2, wherein said ribbed surfaces comprise a plurality of substantially horizontal ribs which, when interengaged, prevent relative movement of said blocks when the latter are mounted in the operating position.

4. Ski boot according to claim 1, wherein said ribbed surfaces operate in a space between said boot leg and said boot body.

5. Ski boot according to claim 4, wherein each said block is provided with a protruding shoulder for engagement of said boot leg and said boot body, respectively.

6. Ski boot according to claim 5, comprising a spring washer snap fitted into position onto the end of said shoulder of said second block.

7. Ski boot according to claim 1, characterized in that said adjustable means are provided at the outer side attachment of said boot leg to said boot body.

* * * * *